United States Patent [19]

Cargill

[11] Patent Number: 5,046,713

[45] Date of Patent: Sep. 10, 1991

[54] DOCUMENT IMPRINTING DEVICE

[75] Inventor: N. Allen Cargill, Warminster, Pa.

[73] Assignee: Technitrol, Inc., Philadelphia, Pa.

[21] Appl. No.: 594,358

[22] Filed: Oct. 9, 1990

Related U.S. Application Data

[62] Division of Ser. No. 354,140, May 19, 1989.

[51] Int. Cl.[5] ..... B65H 1/02

[52] U.S. Cl. ..... 271/149; 271/119; 271/127; 271/160; 271/178; 271/220; 400/629

[58] Field of Search ..... 400/624, 628, 629, 649; 271/149, 160, 127, 119, 178, 220, 179, 181, 147, 126

[56] References Cited

U.S. PATENT DOCUMENTS

| | | | |
|---|---|---|---|
| 4,272,067 | 6/1981 | Yoshida et al. | 271/160 |
| 4,509,738 | 4/1985 | Aoki | 271/160 |
| 4,715,393 | 12/1987 | Godlewski | 271/119 |
| 4,953,748 | 9/1990 | Wheelock | 271/160 |
| 4,957,285 | 12/1990 | Yamada | 271/147 |
| 4,958,950 | 9/1990 | Kobayashi et al. | 400/649 |

*Primary Examiner*—Eugene H. Eickholt

*Attorney, Agent, or Firm*—John F. A. Earley; John F. A. Earley, III

[57] ABSTRACT

A document imprinting device for imprinting on documents such as checks comprises a frame, a document feeding mechanism mounted on the frame for sequentially feeding documents, a conveying mechanism for conveying a document from the document feeding mechanism along a document conveyance path, an imprinting mechanism for imprinting the documents conveyed along the document conveyance path, and a sensing mechanism positioned along the document conveyance path for sensing the position of the documents and for triggering the imprinting mechanism such that the document is imprinted at a desired location on the document. A method of imprinting a document such as a check comprises the steps of feeding the documents sequentially into a document conveyance path so that a space is created between each sequentially fed document, conveying the documents along the document conveyance path, sensing the position of the documents and triggering the rotation of a printing drum to imprint each document as each document is conveyed past the printing drum.

1 Claim, 6 Drawing Sheets

DOCUMENT IMPRINTING DEVICE

This application is a division of U.S. Ser. No. 354,140, filed on May 19, 1989.

BACKGROUND OF THE INVENTION

1. Field of the Invention

This invention relates to document imprinting devices, and more particularly concerns document imprinting devices for imprinting endorsements at a desired location on the back of a check.

2. Description of the Prior Art

Prior to 1988, there were no set standards in the banking industry regarding the placement of a payee endorsement, a subsequent collecting bank endorsement and a bank of first deposit (depository bank) endorsement on the back of a check. As a result, many times one endorsement would be placed over another endorsement resulting in making one or both of the endorsements unreadable.

In particular, the overlapping of a payee endorsement or a subsequent collecting bank endorsement with a bank of first deposit endorsement resulted in making the bank of first deposit nine digit routing number unreadable, and this was a problem.

Effective Sept. 1, 1988, the United States Federal Reserve System set standards for endorsing checks in the United States in Federal Regulation CC. The standards set out in Federal Regulation CC designate specific areas on the back of a check for the placement of a payee endorsement, a subsequent collecting bank endorsement, and a bank of first deposit endorsement, and these designated areas are defined by distances from the left end of the back of a check (when a check is turned over from left to right), which is known as the "leading edge", and the right end of the back of the check, which is known as the "trailing edge".

In particular, the designated or preferred placement for the payee endorsement is within the space between the trailing edge of the check and 1½ inches from the trailing edge of the check. The preferred placement for the subsequent collecting bank endorsement is the space between the leading edge of the check and three inches from the leading edge of the check, and the placement designated for the bank of first deposit endorsement is the space on the back of the check between three inches from the leading edge and 1½ inches from the trailing edge.

By having specific endorsement locations designated and used, there is no overlap of endorsements where one or both of the endorsements in the overlap become unreadable.

Further, by using designated placement areas for the payee endorsement, the subsequent collecting bank endorsement, and the bank of first deposit endorsement, the return check handling process is significantly speeding up. Moreover, bank customers may realize a cost saving via a lower bank service charge if they make the appropriate endorsement on a check instead of the bank since then the bank does not have to endorse the check, and does not have to make a charge for endorsing the check.

The process of manually endorsing checks with a payee endorsement, a subsequent collecting bank endorsement, or a bank of first deposit endorsement in the appropriate designated area is very time consuming.

SUMMARY OF THE INVENTION

It is an object of the invention to provide a document imprinting device that imprints at a desired location on a document.

Another object of the invention is to provide a document imprinting device that automatically imprints an endorsement in the appropriate designated area on the back of a check.

Another object of the invention is to provide a document imprinting device that can handle a plurality of checks of the same size or different sizes.

These and other objects are accomplished by providing a document imprinting device for imprinting on documents such as checks that comprises a frame, a document feeding means mounted on the frame for sequentially feeding documents, conveying means for conveying a document from the feeding means along a document conveyance path, imprinting means for imprinting the documents conveyed along the document conveyance path, and sensing means positioned along the document conveyance path for sensing the position of the documents and for triggering the imprinting means such that the document is imprinted at a desired location on the document.

DETAILED DESCRIPTION

Figure 1:
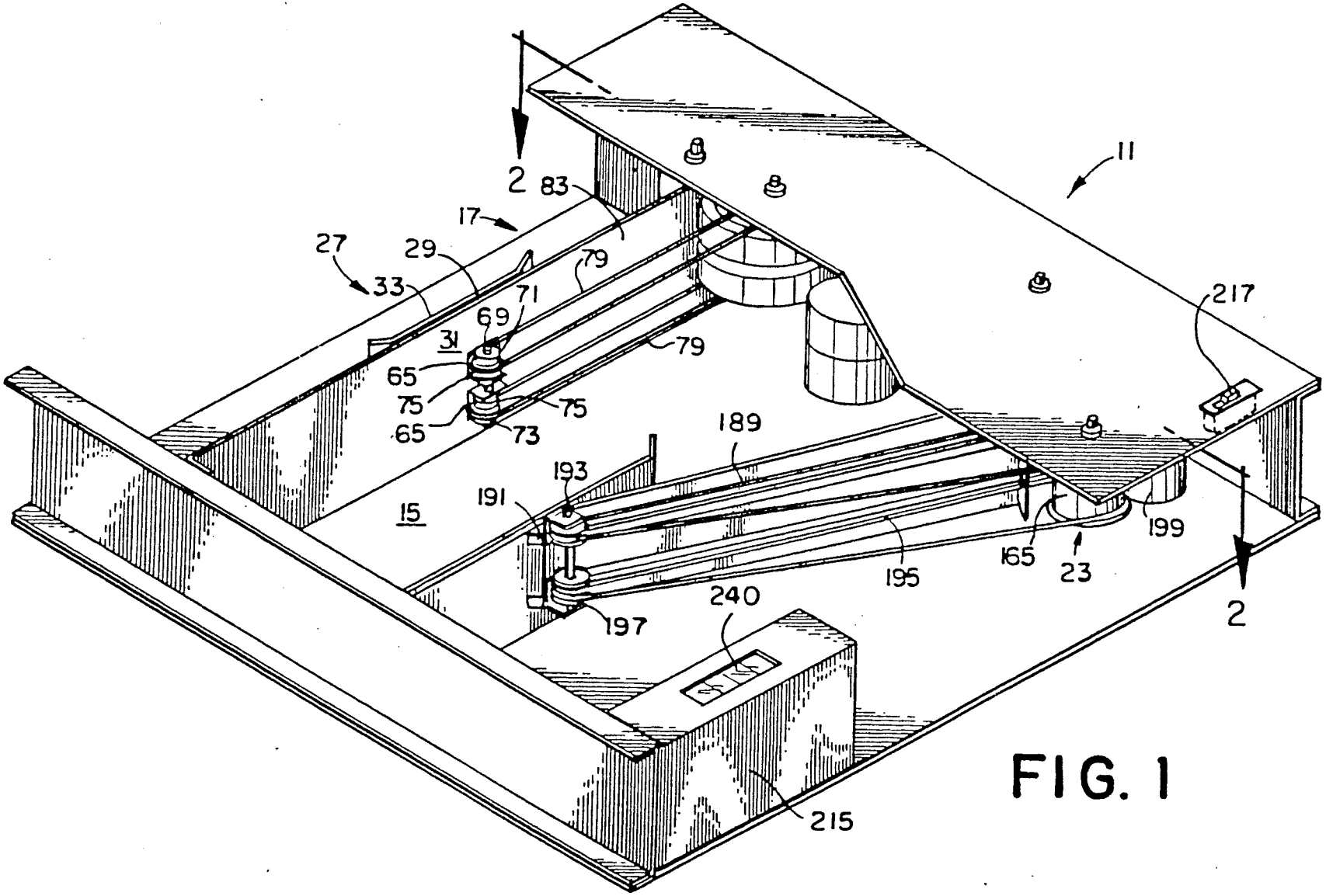
FIG. 1 is a perspective view of a document imprinting device.
Figure 2:
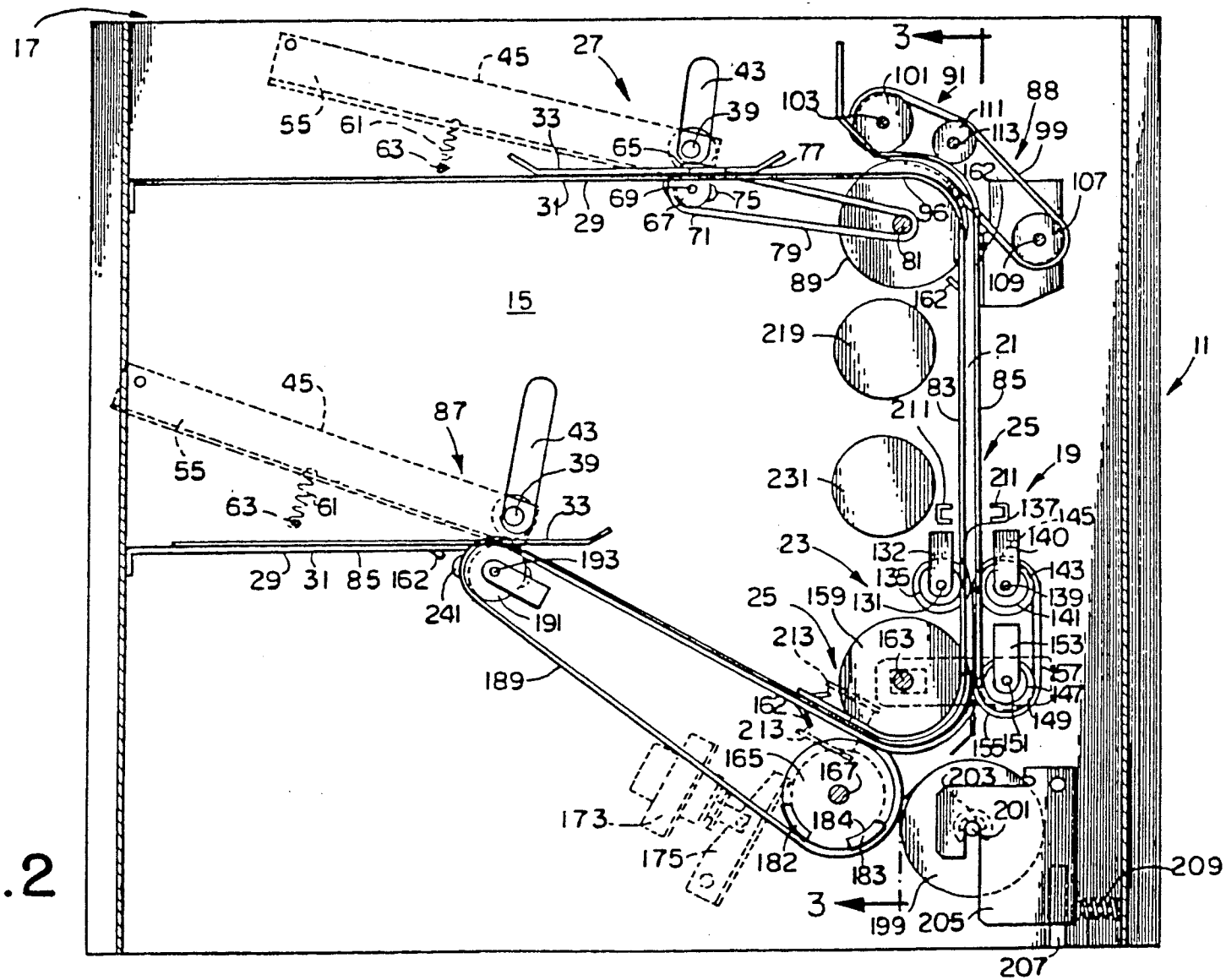
FIG. 2 is a view in section taken along lines and arrows 2—2 of FIG. 1.
Figure 7:
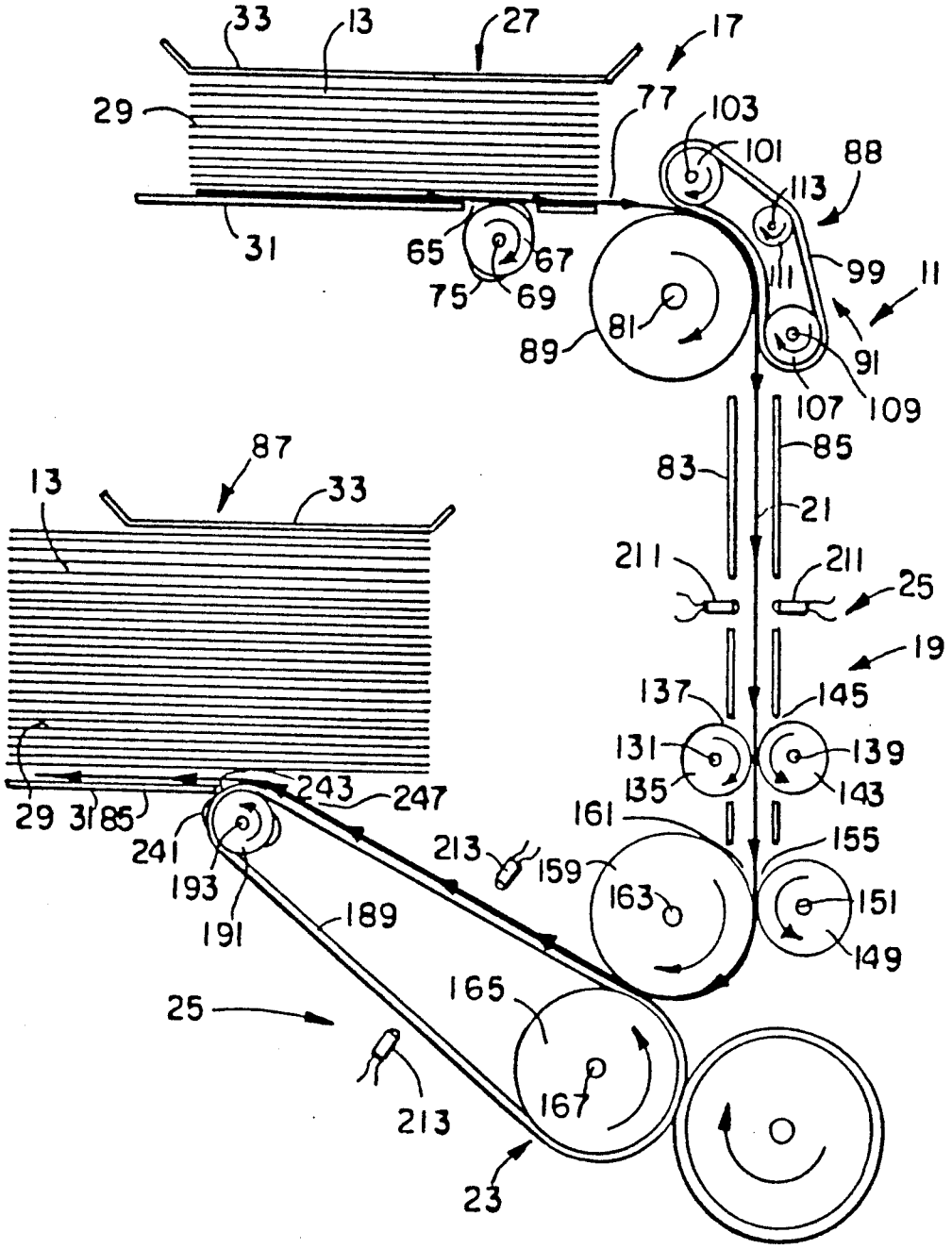
FIG. 7 is a schematic view of the document imprinting device of FIG. 1 in operation.

Turning to the drawings, there is shown in FIGS. 1, 2 and 7 a document imprinting device 11 for imprinting on documents such as checks 13.

Document imprinting device 11 comprises a frame 15, document feeding means 17 mounted on frame 15 for sequentially feeding checks 13, conveying means 19 for conveying a check 13 from the document feeding means 17 along a document conveying path 21, imprinting means 23 for imprinting an endorsement on check 13 being conveyed along document conveyance path 21, and sensing means 25 positioned along document conveyance path 21 for sensing the position of checks 13 and for triggering the imprinting means 23 such that each check 13 is imprinted with an endorsement at a desired location on the back of each check 13.

Document feeding means 17 has a first follower apparatus 27 that includes a hopper or compartment 29 for holding a stack of checks 13 that are to be endorsed. Hopper 29 is provided with a stationary front wall 31 and a slidable rear wall or follower 33.

Figure 8:
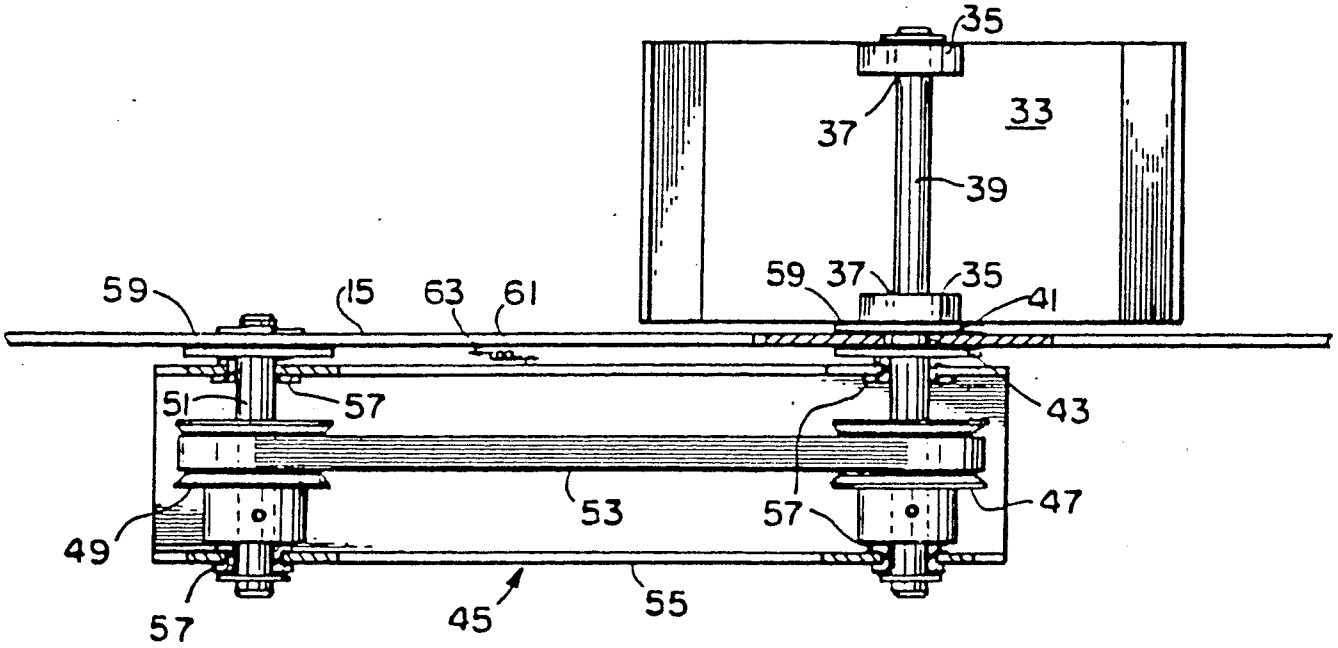
FIG. 8 is a view in section showing a follower apparatus.

Follower 33, as shown in FIG. 8, is provided with a pair of flanges 35 which extend outwardly from the back side of follower 33. Flanges 35 are each provided with a hole 37 that accepts the upper end of a shaft 39 to fix the follower 33 to shaft 39. A spacer 41 is provided around shaft 39 between lower flange 35 of follower 33 and the top of frame 15.

Shaft 39 extends downwardly through a slot 43 in frame 15 to an arm mechanism 45.

Arm mechanism 45 includes a first positive drive pulley 47 fixed to the lower end portion of shaft 39 and a second positive drive pulley 49 fixed to a shaft 51 that is non-rotatably mounted on the underside of frame 15. A positive drive belt 53 is supported at one end by pulley 47 and at the other end by pulley 49. Pulleys 47 and 49 and belt 53 are housed in a C-shaped housing 55, with shaft 39 extending through the first end portion of housing 55 and with shaft 51 extending through the second end portion of housing 55. Bearings 57 are provided on shafts 39 and 51 where shafts 39 and 51 extend through housing 55. Spacers 59 are provided around shafts 39 and 51 between housing 55 and the underside of frame 15.

In order to bias follower 33 towards the front wall 31 of hopper 29, a spring 61 is mounted at one end to a pin 63 extending downwardly from the underside of frame 15 and at its other end to housing 55.

Due to the structure of arm mechanism 45, follower 33 remains in a plane that is parallel to the plane of hopper front wall 31 as shaft 39, with follower 33 fixed thereon, moves laterally back and forth in slot 43 since lateral movement of shaft 39 in slot 43 causes shaft 39 to turn slightly to hold follower 33 parallel to front wall 31, due to the action of pulleys 47 and 49 and belt 53 of arm mechanism 45.

An opening 65 (FIG. 2) is provided at hopper front wall 31, and a picker 67 is mounted on frame 15 at opening 65.

Picker 67 includes a rotatable shaft 69 extending upwardly from frame 15, an upper positive drive pulley 71 mounted on the upper portion of shaft 69, and a lower positive drive pulley 73 (FIG. 3) mounted on the lower portion of shaft 69.

Joggle wheels 75 having an eccentrically shaped circumference are mounted on the upper end portion and lower end portion of shaft 69 and extend partially through openings 65 into hopper 29 of first follower apparatus 27 so that as shaft 69 rotates, joggle wheels 75 remove checks 13 sequentially from hopper 29 through document exit opening 77 located at the front portion of hopper 29. Further, due to the eccentrically shaped circumference of joggle wheels 75, as shaft 69 rotates, joggle wheels 75 joggle the stack of checks 13 as each check is removed from hopper 29.

In order to drive picker 67, continuous belt 79 are provided that engage upper and lower pulleys 71 and 73 and extend to the upper and lower portions of a shaft 81, and as shaft 81 rotates, continuous belts 79 rotate pulleys 71 and 73 causing picker 67 to rotate and to remove checks 13 sequentially from hopper 29 through document exit opening 77.

Document conveyance path 21 includes a pair of guide plates 83, 85 mounted on frame 15 and spaced apart from each other in a parallel relationship, and guide plates 83 and 85 extend from hopper 29 of first follower apparatus 27 (guide plate 83 forming hopper front wall 31 of follower apparatus 27) through conveying means 19 and imprinting means 23 to a second follower apparatus 87 for holding checks 13 in a stack after checks 13 have been endorsed, guide plate 85 forming hopper front wall 31 of second follower apparatus 87.

Adjacent to document exit opening 77 of hopper 29 of first follower apparatus 27, a document separating apparatus 88 is provided for assuring separation of adjacent checks 13 being fed from hopper 29 of first follower apparatus 27. Document separating apparatus 88 is shown and described in Technitrol U.S. Pat. No. 4,500,084, issued Feb. 19, 1985, which is incorporated herein by reference.

Document separating apparatus 88 (FIGS. 2, 3, and 7) includes a feed roller 89 mounted for rotation on rotating drive shaft 81, and a stripper mechanism 91 mounted on frame 15 in opposed relationship to feed roller 89 for counter-rotation to the rotation of feed roller 89, are provided for receiving documents fed from hopper 29 of first follower apparatus 27.

Feed roller 89 includes a pair of friction drums or rolls 93 and 95 which are fixed to drive shaft 81 to rotate together, and feed roller 89 extends partially through an opening 96 in guide plate 83 and moves in the direction of feed of checks 13 to contact the back side of each check 13 and move each check 13 along document conveyance path 21. A free-wheeling idler pulley 97 (FIG. 3) is positioned on drive shaft 81 between friction drums 93 and 95. The support structure is illustrated in Technitrol U.S. Pat. No. 4,500,084, issued Feb. 19, 1985, and U.S. patent application Ser. No. 205,783, filed Nov. 10, 1980, which are incorporated herein by reference.

Stripping mechanism 91 includes a resilient stretchable deformable friction belt 99 that is supported at one end on a drive pulley 101 mounted on a drive shaft 103 rotatably mounted on frame 15 for rotation about its longitudinal axis which is parallel to and spaced from the rotational axis of friction drums 93 and 95. Drive pulley 101 is fixed to drive shaft 103, and as drive shaft 103 rotates, drive pulley 101 rotates therewith causing friction belt 99 to be driven. Shafts 81 and 103 are driven by a drive mechanism 105 (FIG. 3) in opposite directions to provide the counter-rotating movement of friction drums 93 and 95 and friction belt 99.

Friction belt 99 is supported at its other end by an idler pulley 107 which is supported on a shaft 109, and the supporting structure for idler pulley 107 and shaft 109 is described in U.S. patent Application Ser. No. 328,951, now Technitrol U.S. Pat. No. 4,416,449, which is incorporated herein by reference.

Another pulley 111 is rotatably supported on a shaft 113 for rotatable movement in a free-wheeling way, and is positioned such that its circumference preferably is such as to not connect but remain spaced from belt 99 in a slack belt condition when no check 13 is passing through document separating apparatus 88. Otherwise stated, pulley 111 preferably does not apply tension to belt 99 in the position where there is no paper passing through the nip of belt 99 and friction drums 93 and 95.

Figure 3:
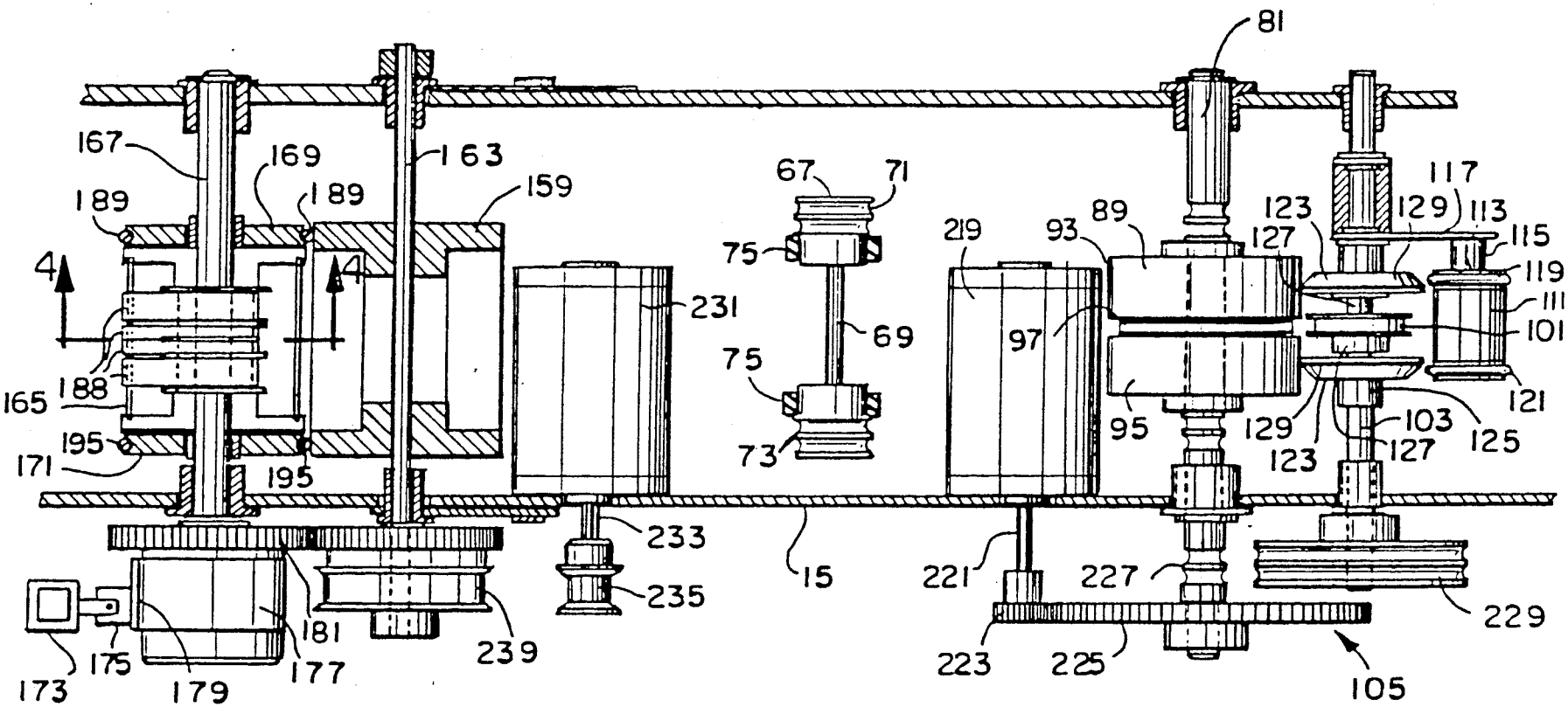
FIG. 3 is a view in section taken along lines and arrows 3—3 of FIG. 2.

Turning to FIG. 3, shaft 113 of pulley 111 is supported on an arm 115 of bracket 117 which, in turn is pivotally supported on shaft 103. The support structure is of such length as to position pulley 111 in the vicinity of the mid point of the wrap around of the friction belt 99 on pulley 97 between friction drums 93 and 95. Arm 115 is movable so that the rim portions 119 and 121 of pulley 111 can move into contact with the friction surfaces of friction drums 93 and 95, but is designed to permit the idler pulley 111 to move away from friction drums 93 and 95 as paper passes through. Pulley 111 is of such a diameter that it contacts friction belt 99 at its outside surface, remote from friction drums 93 and 95 only slightly, if at all, in the slack condition of belt 99 when no checks are passing through. Some variation of this is permissible but the optimum would be to have no tension applied in the condition when no documents are passing between belt 99 and friction drums 93 and 95.

Stripper mechanism 91 also a pair of stripper idlers 123 each of which is mounted for free-wheeling rotation on drive shaft 103 by means of a centrally located journal 125 thereof, and is made of a high friction elastomer and has a generally shallow cup-shaped configuration. Idler pulley 107 for belt 99 is located centrally between stripper idlers 123 which are spaced axially therefrom by spacers 127.

Stripper idlers 123 are identical in construction but are mounted on shaft 103 to face in opposite direction.

The geometry of each stripper idler 123 is such that the resiliency thereof will maintain the proper force or pressure against the feed roller 89 provided by friction drums 93 and 95 for a check positioned between stripper idlers 123 and friction drums 93 and 95 to achieve the document stripping and feeding action. To this end, each stripper idler 123 has a thin circular rim 129 which is highly flexible, and the spacing of shafts 81 and 103 in the radius of rim 129 is such as to cause an interference fit between rim 129 and friction drums 93 and 95. The structure of each idler 123 permits its rim to provide the desired pressure against friction drums 93 and 95 or checks passing therebetween.

Stripper idlers 123 are constructed and arranged to assist in the separation of checks from a stack in hopper 29 of first follower apparatus 27 and to assure the separating of adjacent bottom documents in the feeding area. When no documents are present between stripper idlers 123 and friction drums 93 and 95, stripper idlers 123 are driven by friction drums 93 and 95 to rotate on the stripper shaft 103 in a free-wheeling manner at the same surface speed as friction drums 93 and 95. Feed drum 89 (FIG. 7) and stripper belt 99 are driven in the counter-rotating manner as shown by the arrows. If more than one check is fed simultaneously from hopper 29 of follower apparatus 27, the check 13 that is closet to guide plate 83 is urged into the nip of the feed drum 89 and the counter-rotating stripper belt 99. When a check 13 passes between stripper idlers 123 and feed drum 89, the high friction therebetween is greatly reduced by the check 13. Feed drum 89 has a higher friction coefficient than stripper idlers 123 (FIG. 3) and operates to feed check 13 that is closest to guide plate 83 through the feeding area, resulting in the checks 13 being fanned out so as to provide a very desirable condition for the ease of separation of the checks 13.

Document separating apparatus 88 (FIG. 2) insures that a space is provided between each check 13 as checks 13 move along document conveyance path 21 to be endorsed, thereby permitting the total number of checks 13 that are endorsed to be counted and thereby insuring that the endorsement on each check 13 is in the desired location.

Conveying means 19, as shown in FIGS. 2 and 7, includes a shaft 131 mounted for rotation on a bracket 132, and shaft 131 is provided with a pair of pressure rollers 135 fixed to shaft 131, and pressure rollers 135 extend partially through openings 137 in guide plate 83. Another shaft 139 mounted for rotation on a bracket 140 adjacent to the outer side of guide plate 85 opposite drive shaft 131 is provided, and a pair of pulleys 141 and a pair of pressure rollers 143 are fixed to shaft 139.

Pressure rollers 143 extend partially through openings 145 in guide plate 85 and act in conjunction with pressure rollers 135 to grasp and move checks 13 along document conveyance path 21.

A pair of idler pulleys 147 (FIG. 2) and a pair of pressure rollers 149 are mounted on another shaft 151 held by bracket 153 adjacent to guide plate 85, and pressure rollers 149 extend partially through an opening 155 in guide plate 85.

A pair of belts 157 connect pulleys 141 and 147, and as drive means (not shown) rotate shafts 131 and 139, pressure rollers 149 are rotated by belts 157.

A platen 159 mounted on frame 15 adjacent guide plate 83 and opposite shaft 151 extends partially through an opening 161 in guide plate 83, and acts in conjunction with pressure rollers 149 to grasp and move checks 13 along document conveyance path 21.

Ramps 162 (FIG. 2) are provided at the end portion of each opening in guide plates 83 and 85 to prevent paper edges from jamming along document conveyance path 21.

Imprinting means 23, as shown in FIGS. 2, 3, and 7, are provided and include platen 159 that is mounted on a rotatable shaft 163, and a print drum or endorser roll 165 fixed to a rotatable shaft 167 mounted on frame 15.

An upper free-wheeling pulley 169, as shown in FIG. 3, is mounted on shaft 167 above print drum 165, and a lower free-wheeling pulley 171 is mounted on shaft 167 below print drum 165.

A solenoid 173 is mounted on the underside of frame 15 and is provided with a pawl 175 that is adapted to engage a wrap spring clutch mechanism 177 at stop collar 179 of clutch mechanism 177.

Clutch mechanism 177 releaseably secures shaft 167 to a input gear 181.

Print drum 165, as shown in FIG. 2, is provided with two locations 182 and 183 where a die member 184 may be mounted. Location 182 is used when a payee endorsement is to be placed on each check 13, and location 183 is used for die member 184 for all other endorsements.

Figure 4:
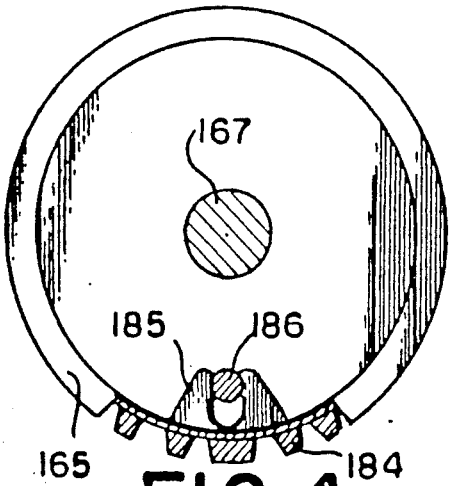
FIG. 4 is a partial view in section taken along the lines and arrow 4—4 of FIG. 3.
Figure 5:
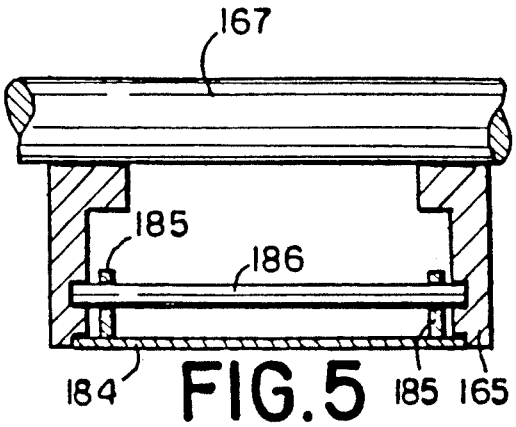
FIG. 5 is a partial cut-away view of a printing drum.

Die member 184, as shown in FIGS. 4 and 5, is provided with a pair of resilient clamp members 185 mounted on its back side and clamp members 185 snap over support rods 186 of print drum 165.

As shown in FIG. 3, print drum 165 also is provided with four rotatable date belts 188 that encircle the circumference of print drum 165, and belts 188 are provided with month/day/year indicators. Belts 188 may be rotated daily so that the correct date is imprinted on each document when print drum is engaged.

A continuous O-ring belt 189 (FIG. 3) extends between upper free-wheeling pulley 169 and an upper pulley 191 mounted on a shaft 193, and a lower continuous belt 195 extends from lower free-wheeling pulley 171 to a lower pulley 197 mounted on shaft 193. Belts 189 and 195 are positioned to contact platen 159 so that a pinch is formed between belts 189 and 195 and platen 159 to grasp and move checks 13 along document conveyance path 21.

An ink roller 199 (FIG. 2) is mounted on a shaft 201, and shaft 201 is rotatably mounted on frame 15 by inserting the lower end of shaft 201 through a hole (not shown) in frame 15 and securing the upper end of shaft 201 in a resilient clamp member 203 mounted on a bracket 205.

An ink roll adjust 207 (FIG. 2) is provided so that the ink roll 199 may be moved closer to or farther from print drum 165, as required. Futher, a spring member 209 is mounted between frame 15 and bracket frame 15 and bracket 205 which holds ink roll 199 to provide some play as die member 187 rolls over ink roll 199.

Sensing means 25 includes a pair of LED/sensors 211 (FIG. 2) and a pair of LED/sensors 213.

LED/sensors 211 are mounted on frame 15 along document conveyance path 21 between document separating apparatus 88 and imprinting means 23 and LED/-sensors 211 are referred to as "trailing edge" LED/sensors since LED/sensors 211 are used to sense or see the trailing edge 214 (FIG. 6) of each check 13 as each check 13 moves past LED/sensors 211. When the trailing edge of each check 13 is sensed or seen by LED/-sensors 211, a signal is sent to control mechanism 215 which subsequently initiates the imprinting means 23 at the appropriate time.

LED/sensors 213 (FIG. 2), known as "leading edge" LED/sensors since LED/sensors 213 sense or see the leading edge 216 (FIG. 6) of each check 13 as each check 13 moves past LED/sensor 213, are mounted on frame 15 along document conveyance path 21 between imprinting means 23 and shft 193. When the leading edge of each check 13 is sensed or seen by LED/sensors 213, a signal is sent to control mechanism 215 which subsequently initiates the imprinting means 23 at the appropriate time.

A switch 217 (FIG. 1) which is linked to control mechanism 215, is provided to allow the operator of the document imprinting device 11 to choose which LED/-sensor pairs (trailing edge LED/sensor pair 211 for a payee endorsement and a bank of first deposit endorsement or leading edge LED/sensor pair 213 for a subsequent bank endorsement) are to be used.

Figure 6:
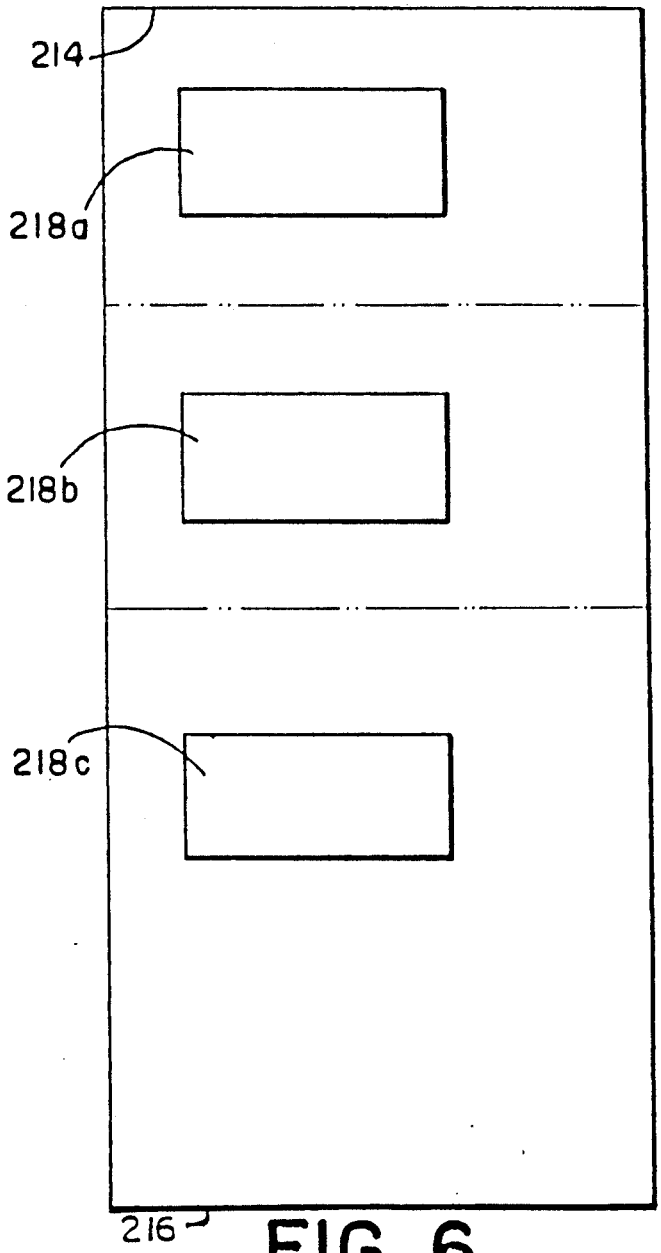
FIG. 6 is a bottom plan view of a check (showing the endorsement areas on the back of a check)

Turning to FIG. 6, the location for a payee endorsement is indicated at 218*a*, the location for a bank of first depsoit endorsement is indicated at 218*b*, and the location for a subsequent collecting bank endorsement is indicated at 218*c*.

A first motor 219 (as shown in FIG. 3) (preferably a 24 volts DC motor) is used to rotate a shaft 221 having a gear 223 mounted on its end portion. As gear 223 rotates, it drives a gear 225 fixed to shaft 81. Continuous belts (not shown) extend around the lower portion 227 of shaft 81 and a pulley 229 fixed to a lower end portion of shaft 103 (FIG. 3). Motor 219 is used to drive conveying means 19.

A motor 231 is used to rotate a shaft 233 (FIG. 3) having a pulley 235 mounted on its end portion. As shaft 233 rotates, it drives a continuous belt (not shown) extending around pulley 235 and a pulley 239 (FIG. 3) fixed to a lower end portion of shaft 163.

Control mechanism 215 (FIG. 1) controls motors 219 and 231 (FIG. 3), solenoid 173 and clutch mechanism 177, and the chosen LED/sensor pair 211 or 213. Further, control mechanism 215 includes a counter for counting the number of checks that have been endorsed, and the total number of endorsed checks 13 is given on screen 240 (FIG. 1). Control mechanism 215 is disclosed in U.S. Pat. No. 4,737,627, issued April 12, 1988, which is incorporated herein by reference.

Joggle wheels 241 (FIG. 2) having a eccentrically shaped circumference are mounted on the upper end portion and lower end portion of shaft 193 and extend partially through openings 243 (FIG. 7) in guide plate 85 (FIG. 7) into hopper 29 of second follower apparatus 87 so that as shaft 193 rotates, joggle wheels 241 insert checks 13 into hopper 29 of second follower apparatus 87 through a document entrance opening 247 (FIG. 7) located at the front portion of hopper 29 of second follower apparatus 87. Further, due to the eccentrically shaped circumference of joggle wheels 241, as shaft 193 rotates, joggle wheels 241 joggle the stack of endorsed checks 13 as each check 13 is inserted into entrance opening 247 (FIG. 7) of hopper 29 of second follower apparatus 87.

Second follower apparatus 87 is positioned downstream of imprinting means 23, and is identical to first follower apparatus 27. Accordingly, since each component of second follower apparatus 87 is the same as each component of first follower apparatus 27, the previous description of the structure of first follower apparatus 27 is descriptive of second follower apparatus 87 (see FIG. 8). Functionally, however, follower apparatus 87 differs from first follower apparatus 27 since second follower apparatus 87 collects checks in a stack in its hopper 29 after each check 13 has been endorsed while first follower apparatus 27 holds checks 13 to be endorsed in a stack in its hopper 29 and positions the stack of checks 13 so that each check 13 may be removed from hopper 29 of first follower apparatus 27 to be endorsed.

Positive control of each check 13 is maintained as it passes along document conveyance path 21 since at least one portion of check 13 is in the grip of feed drum 89 and stripper mechanism 91, pressure rollers 135 and 143 (FIG. 2), pressure roller 149 and platen 159, or continuous belts 189, 195 and platen 159.

In operation, a stack containing up to about 200 checks 13 that are to be endorsed are placed in hopper 29 of first follower apparatus 27. Checks 13 rest in hopper 29 on their long edges, and the back of checks 13 face towards follower 33. The leading edge 216 of each check 13 is to the right portion of the hopper 29 when looking at hopper 29 from front wall 31 to follower 33 (FIG. 7), and each leading edge in the stack is aligned with the leading edges 216 of the other checks 13 in the stack, and this permits a stack containing checks of various sizes, that is, the stack comprising a mixture of checks having different sizes, to be handled by document imprinting device 11.

Checks 13 are removed sequentially from hopper 29 and are moved along document conveyance path 21 past feed roller 89 and stripper mechanism 91 to insure that a space has been created between each check.

Checks 13 are then driven around platen 159 into the pinch between platen 159 and print drum pulleys 189, 195.

If a payee endorsement and/or a bank of first deposit endorsement is to be made, trailing-edge LED/sensor pair 211 is activated by switch 217, and as the trailing edge 214 of each check 13 passes trailing-edge LED/-sensor pair 211, a signal is sent to control mechanism 215 which causes clutch 177 to lock shaft 167 to gear 181 and print drum 165 to rotate. As print drum 165 rotates, die member 184 rolls first against ink roller 199 and then against the back of the check 13 that is between printer drum belts 189, 195 and platen 159. After the endorsement is made, shaft 167 and printer drum 165 are unlocked from gear 181, and printer drum 165 stops rotating until the training-edge LED/sensor pair 211 sees trailing edge 214 of another check 13 and sends another signal to control mechanism 215 to activate printing means 23 again.

If a subsequent bank endorsement is to be made, leading-edge LED/sensor pair 213 is activated by switch 217, and as the leading edge 216 of each check 13 passes leading-edge LED/sensor pair 213, a signal is sent to control mechanism 215 which causes clutch 177 to lock shaft 167 to gear 181 and print drum 165 to rotate. As print drum 165 rotates, die member 184 rolls first against ink roller 199 and then against the back of the check 13 that is between printer drum belts 189, 195 and platen 159. After the endorsement is made, shaft 167 and printer drum 165 are unlocked from gear 181, and printer drum 165 stops rotating until the leading-edge LED/sensor pair 213 sees leading edge 216 of another check 13 and sends another signal to control mechanism 215 to activate printing means 23 again.

Proper placement of the chosen endorsement on checks 13 is independent of the speed at which checks 13 are fed through document conveyance path 21 due to the positioning of the LED/sensor pairs 211 and 213.

Since drum member 165 rotates only when an endorsement is to be made, no ink is transferred onto platen 159.

The method of printing a document such as a check having a leading edge, comprises the steps of feeding the document sequentially into a document conveyance path so that a space is created between each sequentially fed document, conveying the document along the document conveyance path, sending the position of the leading edge of each check, triggering the rotation of a printing drum having a die member secured thereon each time a leading edge of a document is sensed, imprinting each document with the die member as the document is conveyed past the printing drum, and stacking each immprinted document.

Another method of imprinting a document such as a check having a trailing edge, comprises the steps of feeding the document sequentially into a document conveyance path so that a space is created between each sequentially fed document, conveying the documents along the document conveyance path, sensing the position of the trailing edge of each check, triggering the rotation of a printing drum having a die member secured thereon each time a trailing edge of a document is sensed, imprinting each document with the die member as the document is conveyed past the printing drum, and stacking each imprinted document.

I claim:

1. A follower apparatus for use on devices that separate and count documents such as checks, comprising an arm mechanism mounted on the underside of a hopper having a first end portion and a second end portion, the arm mechanism having a first pulley at its first end portion and a second non-rotating pulley at its second end portion, a continuous belt extending between the first and second pulleys, a slot formed in the hopper, a rotatable shaft being fixed to the first pulley and extending through the slot, and a panel fixed to the shaft, said panel forming the rear wall of the hopper, and said panel being rotatable with the shaft to maintain its orientation in the hopper as the shaft moves laterally back and forth in the slot.

* * * * *